US005655442A

United States Patent [19]

Conrad et al.

[11] Patent Number: 5,655,442

[45] Date of Patent: Aug. 12, 1997

[54] CALENDER FOR THE TREATMENT OF A PAPER WEB

[75] Inventors: Hans-Rolf Conrad, Dormagen; Franz Kayser, Geldern, both of Germany

[73] Assignee: Voith Sulzer Finishing GmbH, Krefeld, Germany

[21] Appl. No.: 612,169

[22] Filed: Mar. 7, 1996

[30] Foreign Application Priority Data

Mar. 9, 1995 [DE] Germany ..... 195 08 351.2
Sep. 20, 1995 [DE] Germany ..... 195 34 911.3

[51] Int. Cl.[6] ..... D21G 1/00; D21G 1/02

[52] U.S. Cl. ..... 100/331; 100/163 R; 100/161; 100/162 R; 100/162 B; 100/163 A; 162/361

[58] Field of Search ..... 162/361, 360.3, 162/358.5, 206, 205; 100/93 RP, 38, 162 R, 162 B, 163 R, 163 A, 161, 176, 168, 170; 492/46, 20, 7

[56] References Cited

U.S. PATENT DOCUMENTS

| | | | |
|---|---|---|---|
| 2,300,994 | 11/1942 | Thiele et al. | 100/163 R |
| 3,291,039 | 12/1966 | Christie | 100/162 R |
| 3,340,796 | 9/1967 | Link | 100/170 |
| 3,451,331 | 6/1969 | Fredrickson et al. | 100/162 R |
| 4,283,690 | 4/1989 | Stotz | 100/163 A |
| 4,736,678 | 4/1988 | Stotz | 100/163 A |
| 5,237,915 | 8/1993 | Rounsley | 100/162 R |
| 5,438,920 | 8/1995 | Koivukunnas et al. | 100/38 |

FOREIGN PATENT DOCUMENTS 0 285 942 10/1988 European Pat. Off. .

*Primary Examiner*—Donald E. Czaja
*Assistant Examiner*—Jose A. Fortuna
*Attorney, Agent, or Firm*—Darby & Darby

[57] ABSTRACT

A calender having one stack of rollers has a working nip formed between a hard roller and a soft roller. A changeover nip is formed between adjacent soft rollers. The changeover nip is arranged approximately in the center of the roller stack. The cumulative weight of the rollers is such that the sum of the loads per unit of length of the working nips disposed above the changeover nip is at least 80 percent of the sum of the loads per unit of length of the working nips disposed below the changeover nip.

20 Claims, 1 Drawing Sheet

24
P
17
18
27a
H
2
1
25
27
10
f1
19
H
11
3
28a
f2
4
f3
12
5
23
16
6
29
13
f4
7
H
14
f5
8
20
26
15
28
9
f6
30
H
21

34
3
32
33

G1
G 100
102
103
105
116
106
107
109

200
202
210
207
205
216
206
208
211
209

302

310
300
305
307
316
306
308
309

CALENDER FOR THE TREATMENT OF A PAPER WEB

BACKGROUND OF THE INVENTION

1. Field of the Invention

The present invention relates to a one roll stack calender for paper web deformation More particularly, the present invention relates to a calender which applies a compressive stress to a paper web in its working nips for a period of time (i.e., a dwell time).

2. Discussion of the Related Art

Calenders for the treatment of paper web are well known. See for example, "Die neuen Superkalanderkonzepte" [The New Supercalender Concepts], Sulzer Papertec Company, May 1994. Such calenders are used to finish coated and uncoated paper webs, e.g., printing papers or silicon base papers. Typically, calenders include metal rollers ("hard rollers") having a smooth, hard surface, to provide a smooth and gloss-like finish to the paper web. Calenders also include rollers that are fabricated with an elastic or soft surface, which evenly compress the paper web. Such soft rollers are commonly referred to as "soft rollers". A changeover nip is provided in calenders to effect even treatment of both sides of the paper web.

Calenders typically include 12 to 16 rollers, wherein the changeover nip is located in the lower half of the calender roller stack. Such calenders are configured to operate so that the paper web, which is traversing from the top toward the bottom of the stack, is deformed to a lesser extent at the top than it is at the bottom. This is because the loading on the stack increases toward the bottom due to the cumulative weight of the rollers and any parts connected to them, such as overhanging weights. This results in a compressive stress and/or dwell time in the working nips that increases from the top of the stack toward the bottom of the stack. Thus, such prior art calenders are disadvantageous in that they have a very tall construction height and are very expensive due to the large number of rollers.

Therefore, it is an object of the present invention to overcome the shortcomings of the prior art calenders and provide an improved calender that has a shorter construction height and lower manufacturing and operating costs.

It is another object of the present invention to provide a calender that provides customary finishing results to a paper web while maintaining a maximum allowable compressive stress in the lowest working nip due to a reduced number of rollers and therefore reduced cumulative weight on the rollers in comparison to prior art calenders.

SUMMARY OF THE INVENTION

The present invention relates to a paper web calender constructed of preferably fewer than 10 rollers, wherein the effective weight of the rollers, and any parts connected to them, is such that the sum of the loads per unit of length of the working nips disposed above the changeover nip is at least 80 percent of the sum of the loads per unit of length of the working nips disposed below the changeover nip. The number of working nips disposed above the changeover nip is approximately equal to the number of working nips disposed below the changeover nip.

It is noted that the sum of the loads per unit of length of the working nips facilitates the mechanical compression effect on the paper web. Even when the sum of the loads per unit of length above the changeover nip is not identical to the sum of the loads per unit of length below the changeover nip, excellent finishing results are obtained, which results satisfy customary requirements.

Because the calender of the present invention has a lower construction height, lower structures can be built, which significantly reduces installation costs. Moreover, the present invention calender is cost-effective both to manufacture and to operate due to the low number of rollers that are used.

In a preferred embodiment, the present invention calender includes a roller stack utilizing eight rollers. Such an eight-roller calender includes three working nips located above and three working nips located below the changeover nip and performs with substantially the same results in comparison to a prior art 12-roll calender. The paper web treatment below the changeover nip is substantially identical to that of prior art calenders. However, the paper web treatment above the changeover nip provides superior paper web deformation in comparison to prior art calenders.

The calender of the present invention provides a high load per unit of length which is applied in the first working nip, so that the paper web immediately undergoes considerable deformation. Therefore, at the same compression stress in the lowest working nip as in a 12-roll calender, higher compression stresses are achieved in the uppermost working nip of an eight-roll calender in accordance with the present invention thereby providing even finishing on both sides of the paper web. In other words, the three roll nips disposed above the changeover nip of an eight-roll calender according to the present invention achieve approximately the same result as the first seven working nips of a 12-roll calender.

The calendering performance is particularly advantageous in that the sum of the products of the dwell time and mean compressive stress in the working nips disposed above the changeover nip are at least 80 percent of the sum of the products of the dwell time and mean compressive stress in the working nips disposed below the changeover nip. Thus, the paper web is approximately evenly deformed in the present invention calender because both the dwell time and the average compressive stress are two decisive factors for paper web deformation.

To maintain the cumulative weight of the rollers as low as possible, the working plane of the roll stack is preferably inclined with respect to a vertical orientation. Thus, only the respective vertical components of the weight of the rollers contribute to the increase in the load per unit of length. It is also advantageous for the rollers to be of a lightweight construction. The hard rollers are made lighter by configuring them to have the smallest possible outer diameter. Regarding the soft rollers, lighter constructions are used instead of compact, heavy rollers with paper coverings. The soft rollers preferably have inner cavity portions. Hollow tubes that are provided with a cover jacket are preferably utilized for the soft rollers. It is noted that the soft rollers have a plastic jacket which is thinner than paper coverings and are thus correspondingly lighter. Further, the soft rollers are made from fiber-reinforced plastic, such as epoxy resin. The fiber reinforcement, particularly carbon fibers, provides both stability and lightweight construction.

It is noted that it is beneficial for both the upper or lower roller to be of a soft roller construction. If both end rollers are soft, the result is a six-roller calender. If only one end roller is soft, roller stacks can be provided with an uneven number of rollers.

A low weight roller can be obtained when the roll jacket is fabricated of a material which does not have sufficient resistance to abrasion. A covering made of an elastic plastic, which has a higher resistance to abrasion than the jacket material, is disposed about the roll jacket. The roll jacket material may consist of lamellar graphite cast iron, i.e., a cast iron with lamellar graphite. Further, its wall thickness can be up to 50% less than that of a prior art chilled cast iron roll jacket. However, the cast iron is not very resistant to abrasion. Nonetheless, this disadvantage effect can be offset by using the soft plastic covering as a protective layer against abrasion. A layer thickness of between 8 and 15 mm, and preferably 10 mm, is sufficient for this purpose. An alternative embodiment of the present invention provides a roller jacket fabricated of spherical graphite cast iron, i.e., a cast iron that contains spherical graphite. This allows up to a 59 percent decrease in wall thickness in comparison with chilled cast iron.

In yet another preferred embodiment of the present invention, at least one hard roller is heated, which enables deformation energy to be added, in the form of heat, so that work can be done with a lower load per unit of length. Further, varying the heating in the different working nips allows a greater degree of adjustment in the finishing of the paper web. It is particularly advantageous for the upper and/or lower rollers to be heated thereby enabling corrective adjustments to be made on both sides of the paper web. Further, it is advantageous for at least the uppermost center roller to be hard and heated so that deformation energy in the form of heat is added to the paper web in the first working nip. This arrangement has the advantage that the upper roller can be constructed in a more cost effective manner, is exposed to lower temperatures, and may be deformed to a greater extent.

Moreover, it is preferred that all hard center rollers be heated. It is noted that if the uppermost and lowest center rollers are hard rollers, the total number or rollers is maintained, but the number of hard rollers and, therefore, the number of heated center rollers is increased by one. This enables more heat energy to be added, or at least the same heat energy to be added at a lower temperature level. Heating of the hard rollers can be provided, for example, by steam. Steam heating is much simpler and more cost-effective than heating with oil, which would be necessary with a prior art heated anti-deflection roller.

Still another preferred embodiment of the present invention calender provides the upper and/or lower rollers as deflection-controllable rollers in which a roller jacket is supported by means of hydrostatic support elements on a bearing that passes through it and is held stationary. The deflection control enables the load per unit of length to be kept constant over the width of the paper web thereby providing an even finishing on the paper web. Such deflection-controllable rollers have a multiple zone control, in which pressure fluid is supplied at varying pressure to support elements in the multiple zone, either individually or in pairs. Further, the individual support elements are disposed tightly against each other so as to have an axial width, for example, of 5 to 20 cm.

BRIEF DESCRIPTION OF THE DRAWINGS

The above and still further objects, features and advantages of the present invention will become apparent upon consideration of the following detailed description of a specific embodiment thereof, especially taken in conjunction with the accompanying drawings wherein.

DETAILED DESCRIPTION OF THE PREFERRED EMBODIMENTS

Figure 1:
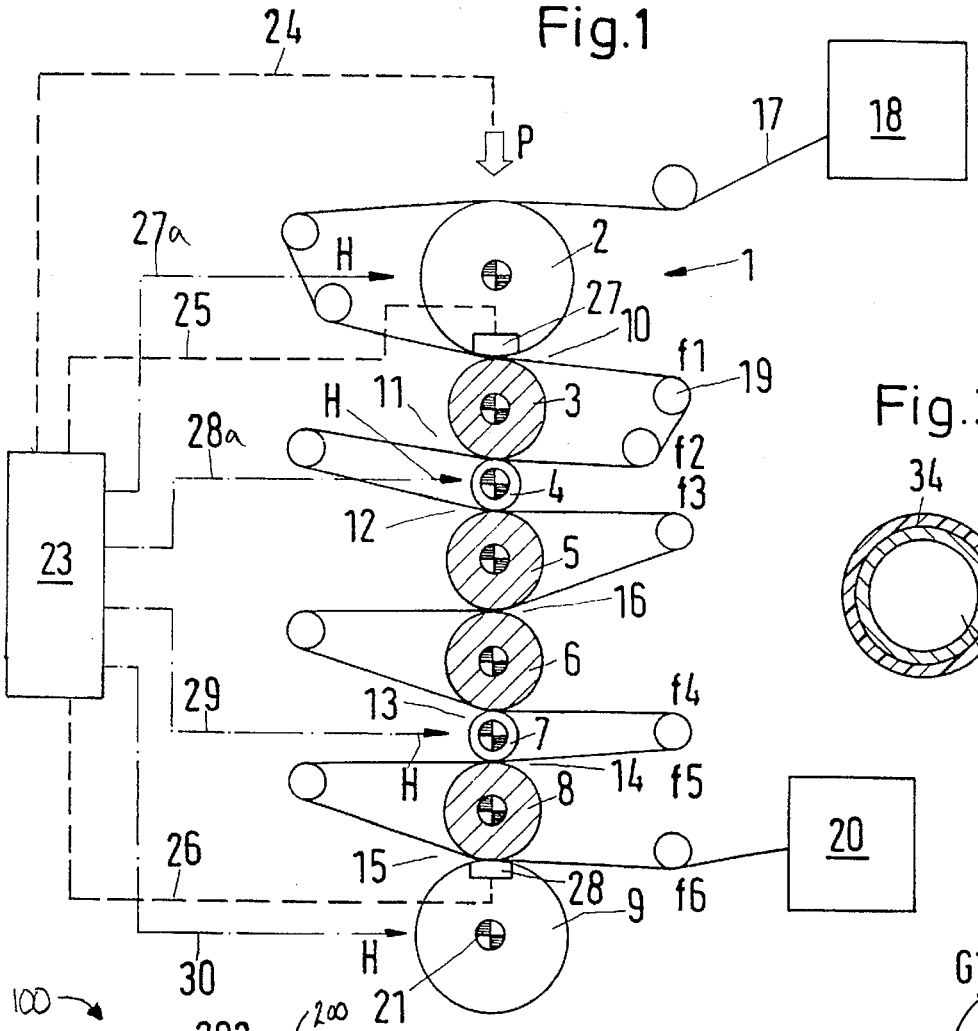
FIG. 1 is a schematic representation of a calender of a preferred embodiment in accordance with the present invention.

Referring now to the drawings, in which like reference numerals identify similar or identical elements, FIG. 1 illustrates a calender 1 having one roller stack which includes eight rollers 2–9. More specifically, calender 1 includes: a heatable deflection-controllable hard upper roller 2; soft rollers 3, 5, 6 and 8; heatable hard rollers 4 and 7; and a heatable, deflection-controllable hard lower roller 9. Thus, calender 1 is provided with six working nips 10–15, each of which is defined intermediate a hard roller (2, 4, 7 or 9) and a soft roller (3, 5, 6 or 8). Calender 1 further includes a changeover nip 16 which is defined intermediate soft rollers 5 and 6.

In operation, a paper web 17 is fed out of a paper machine 18, and traverses through each working nip 10–15 and changeover nip 16 via guide rolls 19. After the paper web 17 passes through working nip 15 (defined by the juncture of soft roller 8 and heatable deflection-controllable hard roller 9), web 17 is wound onto a winding device 20. In particular, when paper web 17 traverses through the upper three working nips 10–12, it is positioned to have a first side adjacent to and contacting hard rollers 2 and 4, and a second side positioned adjacent to and contacting soft rollers 3 and 5. When paper web 17 traverses through the three lower working nips 13–15, web 17 is positioned to have its first side adjacent to and contacting soft rollers 6 and 7, and its second side adjacent to and contacting hard rollers 7 and 9. Therefore, the desired surface structure, such as smoothness or gloss, is produced on both sides of paper web 17.

As described above, a direct connection is formed between calender 1 and paper machine 18, which results in an in-line operation. To achieve an in-line operation of calender 1, each roller 2–9 is provided with a dedicated independent drive unit 21 to facilitate the extraction of paper web 17 from paper machine 18.

A control device 23 is provided in calender 1 and is operatively connected to the calender to apply a downward force P onto upper roller 2. Force P is controlled by device 23 along control line 24. Lower roller 9 is preferably stationary when the downward force is applied to upper roller 2. It is to be appreciated that control device 23 may be configured to apply an upward load onto lower roller 9 whereby force P acts on lower roll 9 and upper roller 2 is held stationary.

Control unit 23 includes control lines 25, 26 to control deflection devices 27 and 28 for effecting deflection compensation on upper roller 2 and lower roller 9. Deflection devices 27, 28 and pressure lines 25, 26 ensure that an even compressive stress is applied over the length of the rolls 2–9, as is known in the art. Any known devices for achieving these effects can be utilized, and particularly those in which support elements are arranged next to each other in a row and can be pressurized individually or in zones at different pressures.

As mentioned above, hard rollers 2, 4, 7, and 9 can be heated. As indicted by arrow H, heat energy applied to each roller 2, 4, 7 and 9 is controlled by control device 23. Further, the amount of heat energy that is added along dot-and-dash paths 27*a*, 28*a*, 29, 30 is controlled by control device 23. The heating may be effected, for example, by electric heating, radiant heating, a heat exchange medium, or the like.

With continued reference to FIG. 1, loading calender 1 with force P results in the first working nip 10 having a load per unit of length f1 which is a function of force P and the effective weight of the upper roll 2. Regarding the second working nip 11, it has a load per unit of length f2 which is dependent on force P and the weights of the two upper rolls 2 and 3. Thus, it follows that the load per unit of length f6 depends on force P and the effective weights of all rollers 2 through 8.

Figure 2:
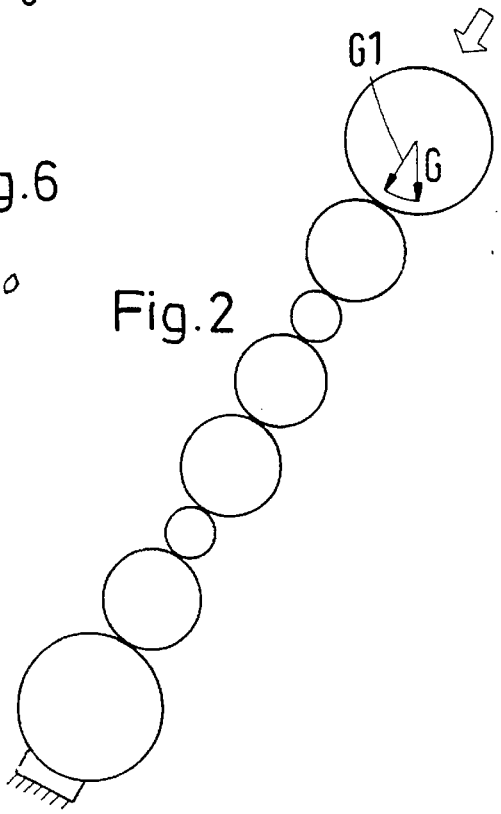
FIG. 2 is another preferred embodiment of the present invention.

In accordance with a preferred embodiment of the present invention, the additional effect of the weight should be kept as low as possible. Various measures can be taken to do so, either individually or in combination. For example, the hard rollers 4 and 7 can have the smallest possible diameter. Additionally, as shown in FIG. 2, the working plane of calender 1 can be orientated obliquely, i.e., inclined relative to its vertical plane. Therefore, the weight components G of each roller 2–9 act only with a reduced component G1, which extends in the direction of the load per unit of length.

As shown in FIG: 3, each soft roller 3, 5, 6 and 8 is fabricated with a support tube or roll jacket 32 made of a material having insufficient abrasion resistance within cavity 33. A plastic covering 34, which may be comprised, for example, of fiber-reinforced epoxy resin, is arranged on roll jacket 32. Therefore, each soft roller 3, 5, 6 and 8 is lighter in comparison to a customary roller having a covering made of a fibrous material. In addition, the soft rollers 3, 5, 6 and 8 have high abrasion resistance due to the plastic covering. Further, the rollers, particularly the middle rollers, are held by levers so that overhanging weights, which increase the effective weight of each roller 2–9, are compensated for, as is known from European reference EP 0 285 942 B1.

Due to the utilization of only eight rollers 2–9, and the slight effect of the weight of each of these rollers, it is noted that at a specified load per unit of length f6 in the lowest working nip 15, a load per unit of length f1 in the uppermost working nip 10 is considerably above the customary values of load per unit of length for an uppermost working nip in a prior art calender. This also applies to loads per unit of length f2 and f3 in working nips 11 and 12. Therefore, the treatment in the first three working nips 10, 11, and 12 closely approximates the treatment in the last three working nips 13, 14, and 15 thereby enabling the finishing effect on both sides of paper web 17 to be substantially equal. Any corrections that are still necessary may be accomplished by varying the heating of the heated rolls 2, 4, 7, and 9 via control device 23.

In order to achieve accurate measurements, the sum of the loads per unit of length $f1+f2+f_3$ of the uppermost working nips 10, 11, and 12 is at least 80 percent of the sum of the loads per unit of length $f4+f5+f_6$ of the three lowest working nips 13, 14, and 15. Further, similar results are obtained when, instead of the load per unit of length in the individual nips, the dwell time t and the compressive stress $\sigma$ in each working nip are taken into consideration by comparing the sum of the products $t \cdot \sigma$ for the three uppermost working nips 10, 11 and 12 with the sum of those products for the three lowest working nips 13, 14, and 15. Here, too, the upper sum should be at least 80 percent of the lower sum.

For example in a preferred embodiment of the present invention, calender 1 was configured to be 8.5 meters wide and have a web speed of approximately 800 meters/minute. By reducing the weight of the soft rollers 3, 5, 6 and 8 by approximately 40 percent, the sum of the products of the average compressive stress $\sigma$ and dwell time t in the working nips 10–12 above the changeover nip 16 amounted to a value that was 82 percent of the sum of the products in the working nips 13–15 located below changeover nip 16. Even higher values, for example, 83 percent through 86 percent, can be achieved for calender 1 by taking any one of the additional measures listed above. Still higher values can be achieved with special configurations, such as utilizing an obliquely stacked configuration.

The values for compressive stress $\sigma$ in the working nip, particularly in the lowest nip, are preferably maintained between $45N/mm^2$ and $60N/mm^2$. Though the utilization of heat energy H, via control device 23, the heated rollers 2, 4, 7, and 9 are preferably maintained at a surface temperature between 100° C. and 150° C. The diameters of the soft rollers 3, 5, 6, 8 and the elasticity of their coverings 34 are selected so that a nip width of about 2 to 15 mm, and preferably about 8 mm, is maintained. These ranges create dwell times t in each working nip 10–15 from 0.1 to 0.9 ms, and preferably from 0.2 to 0.5 ms. It should be noted that the dwell time is a function of the web speed. It is preferable for the temperature T to be only slightly above the lower limit, for example 110° C., when the compressive stress $\sigma$ is only slightly above the lower limit, for example, $50N/mm^2$. Compared with a 12-roller calender, slight increases in thermal and mechanical energy are therefore sufficient to obtain the same finishing results using an eight-roller calender 1 in accordance with the preferred embodiment of the present invention.

According to the above described calender arrangement, a four-roller calender can also be built that is sufficient for simpler applications which achieves approximately similar finishing on both sides of a paper web.

Figure 4:
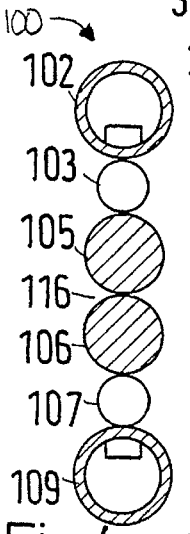
FIG. 4 is a schematic diagram of a six-roller calender in accordance with the present invention.

Referring now to FIG. 4, calender 100 includes a soft upper roller 102 and a soft lower roller 109. The changeover nip 116, which is located in the center of calender 100 is defined by soft rollers 105 and 106. Hard rollers 103 and 107, which are respectively adjacent to end rollers 102 and 109, are preferably heated with steam which is supplied by steam pressure means.

Figure 5:
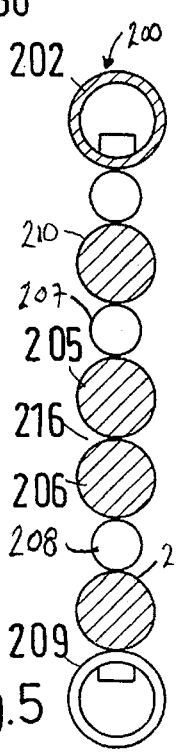
FIG. 5 is a schematic diagram of a nine-roller calender in accordance with the present invention.

In the above described preferred embodiments of the present invention, the changeover nip (i.e., 16, 116) was located in the center of a calender which had an even number of rollers. In contrast, FIG. 5 illustrates a calender 200 having an odd number of rollers (i.e., nine). Included in calender 200 is a soft upper roller 202 and a hard lower roller 209. The changeover nip 216 is arranged between the centermost, soft roller 205 and the adjacent soft roller 206. Moreover, heated hard center rollers 207 and 208 alternate with soft rollers 205, 210 and 206, 211, respectively.

Figure 6:
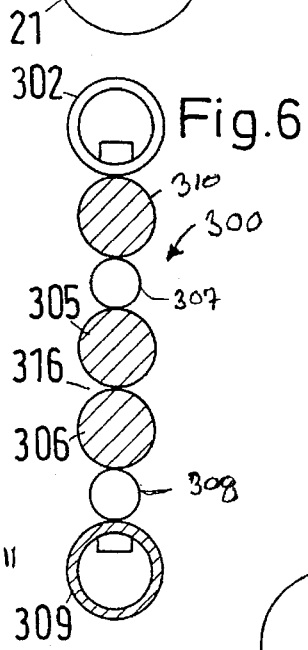
FIG. 6 is a schematic diagram of a seven-roller calender in accordance with the present invention.

Referring now to FIG. 6, calender 300 includes seven rollers. Included in calender 300 is a hard upper roller 302 and a soft lower roller 309. The changeover nip 316 is located between the centermost soft roller 305 and the adjacent soft roller 306. Moreover, heated hard center rollers 307 and 308 alternate with soft rollers 305, 310 and 306, 309, respectively.

Figure 3:
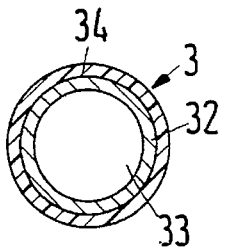
FIG. 3 is a cross-sectional view of a soft roller of FIG. 1.

Referring now to FIGS. 4–6, each upper roller 102, 202, 302 and lower roller 109, 209 and 309 of calenders 100, 200 and 300, respectively are provided with hydraulic support elements in fashion similar to that previously described with respect to upper roller 2 and lower roller 9 of calender 1 (FIG. 1 ). Further, the roll jacket on each soft roller of calenders 100, 200 and 300 may be constructed in a similar manner to that shown in FIG. 3. For example, each soft roller of calenders 100, 200 and 300 may have a support tube fabricated of spherical or lamellar graphite cast iron, which support a soft plastic covering.

Having described the presently preferred exemplary embodiments of a calender for webs of paper in accordance with the present invention, it is believed that other modifications, variations and changes will be suggested to those skilled in the art in view of the teachings set forth herein. It is, therefore, to be understood that all modifications, variations and changes are believed to fall within the scope of the present invention without departing from the spirit and scope of the invention as disclosed above.

What is claimed is:

1. A calender for treating webs of paper comprising:

a plurality of rollers including an upper hard roller, a lower hard roller and at least two center soft rollers positioned intermediate said upper and lower hard rollers;

at least two working nips, each of said working nips being defined by the juncture of one hard roller and one soft roller, each of said working nips being loaded by a predetermined load per unit length value; and a changeover nip being defined by the juncture of two of said at least two soft rollers, where the sum of the loads per unit of length of the working nips disposed above said changeover nip is at least 80% of the sum of the loads per unit of length of the working nips disposed below said changeover nip.

2. The calender for webs of paper as recited in claim 1, wherein said calender includes eight rollers including first soft and hard rollers positioned intermediate said upper hard roller and said two center soft rollers, and second hard and soft rollers positioned intermediate said lower hard rollers and said two center soft rollers.

3. The calender for webs of paper as recited in claim 1, wherein the sum of the products of the dwell time and average compressive stress in said working nips disposed above said changeover nip is at least 80 percent of the sum of the products of the dwell time and average compressive stress in said working nips disposed below said changeover nip.

4. The calender for webs of paper as recited in claim 1, wherein the calender is orientated at an acute angle relative to a horizontal plane.

5. The calender for webs of paper as recited in claim 1, wherein each of said soft rollers is provided with an inner cavity portion.

6. The calender for webs of paper as recited in claim 1, wherein each of said soft rollers is provided with an outer plastic jacket.

7. The calender for webs of paper as recited in claim 1, wherein each of said soft rollers is made from fiber-reinforced plastic.

8. The calender for webs of paper as recited in claim 1, further including at least one soft roller positioned adjacent to and above said at least one upper hard roller.

9. The calender for webs of paper as recited in claim 1, further including at least one soft roller positioned adjacent to and below said at least one lower hard roller.

10. The calender for webs of paper as recited in claim 1, wherein each of said soft rollers includes an outer roll jacket and an outer support covering fabricated of a soft material, which has a higher resistance to abrasion than said outer roll jacket.

11. The calender for webs of paper as recited in claim 10, wherein said outer roll jacket is made from lamellar graphite cast iron.

12. The calender for webs of paper as recited in claim 10, wherein said outer roll jacket is made from spherical graphite cast iron.

13. The calender for webs of paper as recited in claim 1, wherein at least one hard roller includes means for heating a surface of said at least one hard roller.

14. The calender for webs of paper as recited in claim 2, wherein at least one of said first and second hard rollers includes means for heating a surface of said at least one of said first and second hard rollers.

15. The calender for webs of paper as recited in claim 2, wherein all said hard rollers include means for heating a surface of said hard roller.

16. The calender for webs of paper as recited in claim 13, wherein said heating means includes steam pressure.

17. The calender for webs of paper as recited in claim 1, wherein at least one of said upper and lower hard rollers is a deflection controllable roller having an outer roll jacket supported by hydrostatic support elements on a bearing passing therethrough.

18. The calender for webs of paper as recited in claim 17, wherein said deflection controllable roller includes a multiple zone control, wherein pressure fluid is supplied at varying pressure to said multiple zones.

19. A calender for treating webs of paper comprising:

a plurality of rollers including an upper hard roller, a lower hard roller and at least two center soft rollers positioned intermediate said upper and lower hard rollers;

at least two working nips, each of said working nips being defined by the juncture of one hard roller and one soft roller, each of said working nips being loaded by a predetermined load per unit length value; and a changeover nip being defined by the juncture of two of said at least two soft rollers, where the sum of the products of the dwell time and average compressive stress in said working nips disposed above said changeover nip is at least 80 percent of the sum of the products of the dwell time and average compressive stress in said working nips disposed below said changeover nip.

20. The calender for webs of paper as recited in claim 19, wherein the sum of the loads per unit of length of the working nips disposed above said changeover nip is at least 80% of the sum of the loads per unit of length of the working nips disposed below said changeover nip.

* * * * *